United States Patent [19]

Schwartz

[11] 3,948,455

[45] Apr. 6, 1976

[54] DISPENSER PACKAGE

[75] Inventor: Richard J. Schwartz, St. Paul, Minn.

[73] Assignee: Minnesota Mining and Manufacturing Company, St. Paul, Minn.

[22] Filed: Nov. 13, 1974

[21] Appl. No.: 523,428

[52] U.S. Cl. ..... 242/55.3; 206/394

[51] Int. Cl.[2] ..... B65H 19/04

[58] Field of Search ..... 242/55.3, 55.53; 206/389, 206/391, 394, 422; 229/2.5; 220/337

[56] References Cited

UNITED STATES PATENTS

| | | | |
|---|---|---|---|
| 1,415,242 | 5/1922 | Johnston, Jr. | 242/55.3 |
| 1,456,401 | 5/1923 | Powell | 206/391 X |
| 3,072,280 | 1/1963 | Spadaro | 220/337 |
| 3,164,478 | 1/1965 | Bostrom | 229/2.5 |

*Primary Examiner*—Leonard D. Christian
*Attorney, Agent, or Firm*—Alexander, Sell, Steldt & DeLaHunt

[57] ABSTRACT

An esthetic dispenser package for shipping, displaying and dispensing convolutely wound rolls of ribbon material, which package permits the visible inspection of the ribbon as to quantity and color and the controlled dispensing during use. The package contains a plurality of hexagonally-shaped chambers formed in a pair of hinged shells in which the wound ribbon may be placed, the rolls of ribbon being wound without a core.

8 Claims, 6 Drawing Figures

DISPENSER PACKAGE

BACKGROUND OF THE INVENTION

1. Field of the Invention

This invention relates to an improvement in packaging for wound goods such as ribbons.

2. Description of the Prior Art

Previous to the present invention, packages for decorative ribbon, including other wound webs e.g., pressure sensitive adhesive tapes with a liner, tapes or labels with a water or heat activatable adhesive, bands or other products, generally included a core on which the ribbon was wound. The free end of the wound material may be taped to the outer layer of the wound material. A plurality of short lengths of ribbon may be convolutely wound in axially spaced relation along the length of a single core with each wound ribbon being secured to itself. The core and the plurality of wound ribbon may then be placed in a square paperboard package having a transparent window to permit the customer to view the contents. Other packages included spools having flanges between which are wound a length of the ribbon or tape material. The flanges serve to protect the material from unravelling or telescoping but the free end must always be secured somehow during shipment and between uses to keep the same neat.

Other prior art packages for loosely wound ribbon material include such packages as shown in U.S. Pat. No. 2,767,833, issued Oct. 23, 1957 to M. W. Hedin, wherein the material is wound on a core, with the core disposed within a rectangular package. This patent provides a package for only a single roll of ribbon or tape and considerable packaging material.

Other patents relating to packages for ribbon and strip material which is convolutely wound include U.S. Pat. No. 2,725,244, issued Nov. 29, 1955 to E. W. Friday. This patent shows a box for a roll of material which may not be on a core and is provided with a guide for the free end of the strip of material. The guide directs the strip of material to a dispensing opening in the corner of the package such that an amount of material may be withdrawn from the package and the free end of the roll held in position for further dispensing. This package provides a window through which one may view a portion of the ribbon just prior to it being dispensed through the dispensing opening.

U.S. Pat. No. 2,589,192, issued Mar. 11, 1952, to J. McLean Johnston, discloses a retractable ribbon dispenser which comprises a box which journals a spool which in turn journals a reel upon which ribbon is wound. This permits the reel to be rotated relative to the package. One end of a length of the ribbon is threaded between two parallel members of the package sufficient to hold the free end of the ribbon. This package permits an edge portion of one of the flanges to be exposed such that the ribbon may be rewound into the package.

U.S. Pat. No. 2,748,931, issued June 5, 1956 to J. Tayler discloses a dispensing container for a plurality of rolls of pressure-sensitive adhesive tape. As illustrated in this patent, the rolls of pressure-sensitive adhesive tape are wound on cores rotatably mounted on a tubular memer which is mounted at its ends in the end walls of the package which may be formed with a viewing window. The package is designed to provide a container for supporting, displaying and dispensing pressure-sensitive adhesive tape from a plurality of different rolls so that the user may have available a variety of different kinds of tape in varying colors, artistic designs, or widths and may select a piece of pressure-sensitive adhesive tape from any one of such rolls. Pressure-sensitive adhesive tape rolls do not easily become unwound but to avoid adjacent portions of tape becoming interengaged or stuck together, each adjacent roll is wound in the opposite direction. The material in this package and the difficulty in packaging the rolls as specified makes the package less economical.

Summary of the Present Invention

AS compared to the packages of the prior art, the present invention provides a novel esthetic package from which to dispense ribbon and permits the user to be able to readily see the amount of ribbon remaining in each roll, permits the rewinding of the ribbon onto the roll, requires less space than previously known packages for decorative ribbon, does not require that the ends of the wound ribbon be adhesively fixed to the rolls or taped initially after each use to prevent the same from unwinding, requires less space in the shipping containers for the ribbon packages, it is a clear transparent package for display, and is provided with a hanger for permitting the packages to be displayed on racks.

The dispenser package of the present invention comprises a pair of mating hinged shells which form a plurality of axially spaced chambers into which a plurality of wound rolls of ribbon-type material may be placed. The package is preferably made in one piece with the mating shells hinged along one axially extending edge portion and formed with friction interfitting fasteners to secure the package together along the opposite edge. Each shell is provided with a plurality of wall members disposed in annular orientation such that the central portion of each wall member will engage the outer convolution of the wound ribbon and preferably the chambers formed by the two shells when in mating engagement define a chamber of hexagonal cross section. Between each chamber are inwardly extending separators or partitions which project into the shell such that each of the partitions will engage the edge of axially end of a roll of wound ribbon at circumferentially spaced positions. Each of the shells is provided with a guide member extending from the edge opposite the edge hinging the two shells together. These guide members support the friction fitting fastening members and provide space between the fastening members for permitting the ribbon to be frictionally held between the guide members and directed toward a dispensing opening. The guide members are preferably formed initially with a friction contact member which also engages the ribbon to retain the free ends of the ribbon in dispensing position. After purchase of the package one portion of the ribbon securing fastening members may be separated along a perforated or scored line to remove the same from the package. The package at one end is provided with a hanger for display of the ribbon package from a spindle or rack. The wound rolls of ribbon material disposed in the plurality of chambers in the package are convolutely wound but are not supported by individual cores or a common core. The package is preferably made of a transparent polymeric material.

BRIEF DESCRIPTION OF THE DRAWINGS

A better understanding of the present invention can be obtained from the following detailed description which refers to the accompanying drawing wherein.

DETAILED DESCRIPTION OF THE PREFERRED EMBODIMENT

Figure 1:
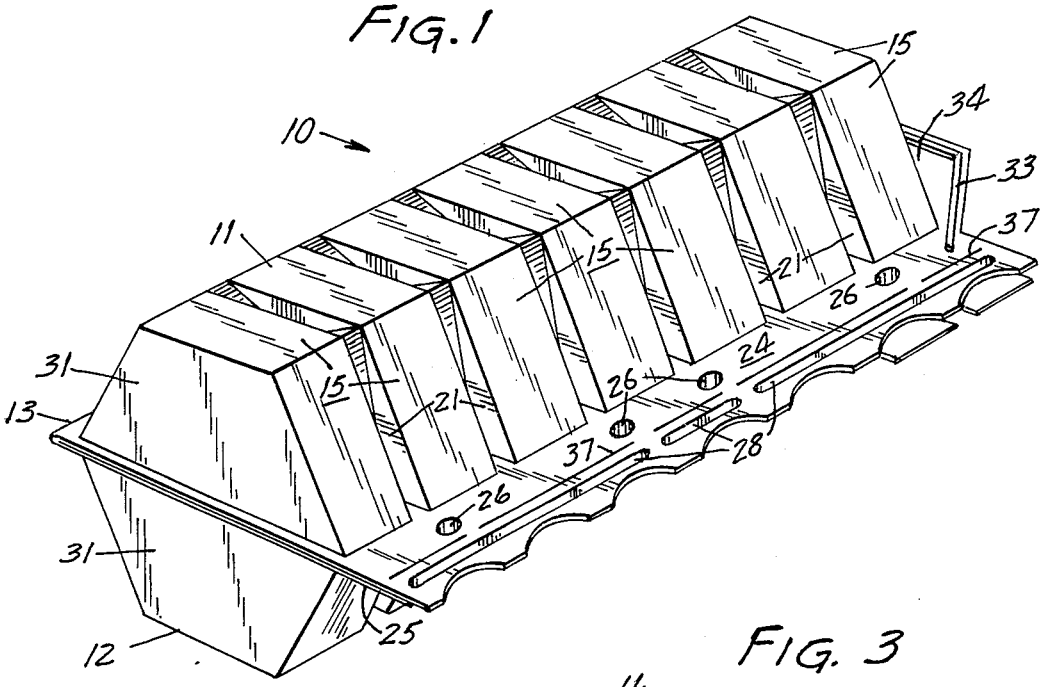
FIG. 1 is a perspective view of a dispenser package according to the present invention.

Referring now to the drawing the package generally designated 10 is formed as by injection molding or thermo-forming from a transparent cellulose propinate or polyvinyl chloride. This material in a thickness of 0.020 inch (0.5mm) provides a film which may be vacuum formed.

The package 10 is formed in one integral piece and comprises two shells, an upper or front shell 11 and a mating receiving or tray shell 12. The two shells are generally similar and are hinged by the material joining the common edges as at 13. The shells are provided with interfering friction-fitted button members formed along the edges opposite the edge 13 such that the package will be held together to contain the multiple rolls of ribbon in the package. The interfering fastening members also permit the shell to be opened in the event one needs to open the package to rewind one of the several rolls of ribbon.

Each shell comprises wall members 15 which define the ribbon chambers 16. The wall members 15 of one chamber are angularly disposed with respect to each other and each has a width slightly greater than the axial dimension of a roll of ribbon 20 or the width of the ribbon. Each roll 20 comprises a length of ribbon which is convolutely wound upon itself without a central core. A roll 20 is placed in each chamber 16 and the outer end of the wound material is passed between two parallelly disposed flange members forming guide means for the ribbon directing it to a dispensing opening. Each roll of ribbon in the package 10 is protected from becoming twisted, frayed or jumbled as is common with ribbon products which are wound on a core with the free edge taped to the outer convolution of the wound ribbon and the core placed in a package from which it is generally removed for use.

Figure 3:
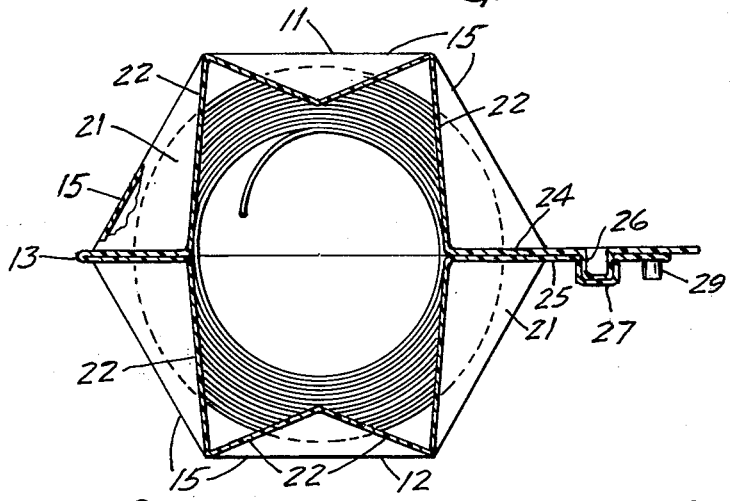
FIG. 3 is a transverse sectional view taken along the line 3—3 of FIG. 2.
Figure 2:
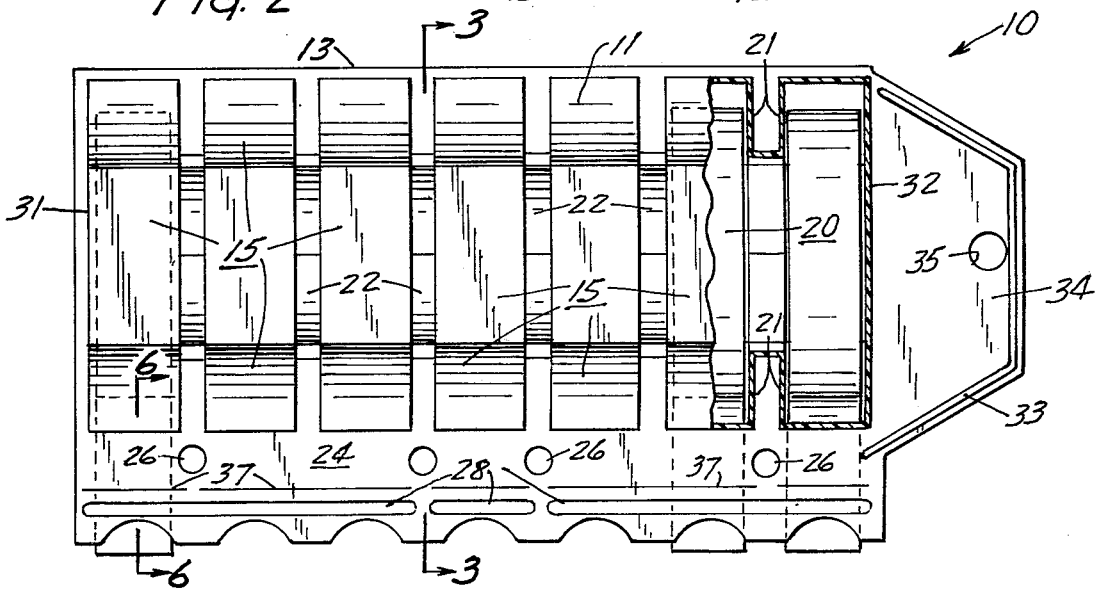
FIG. 2 is a top plan view of the package of FIG. 1 with a portion broken away at one end to show the interior thereof.
Figure 4:
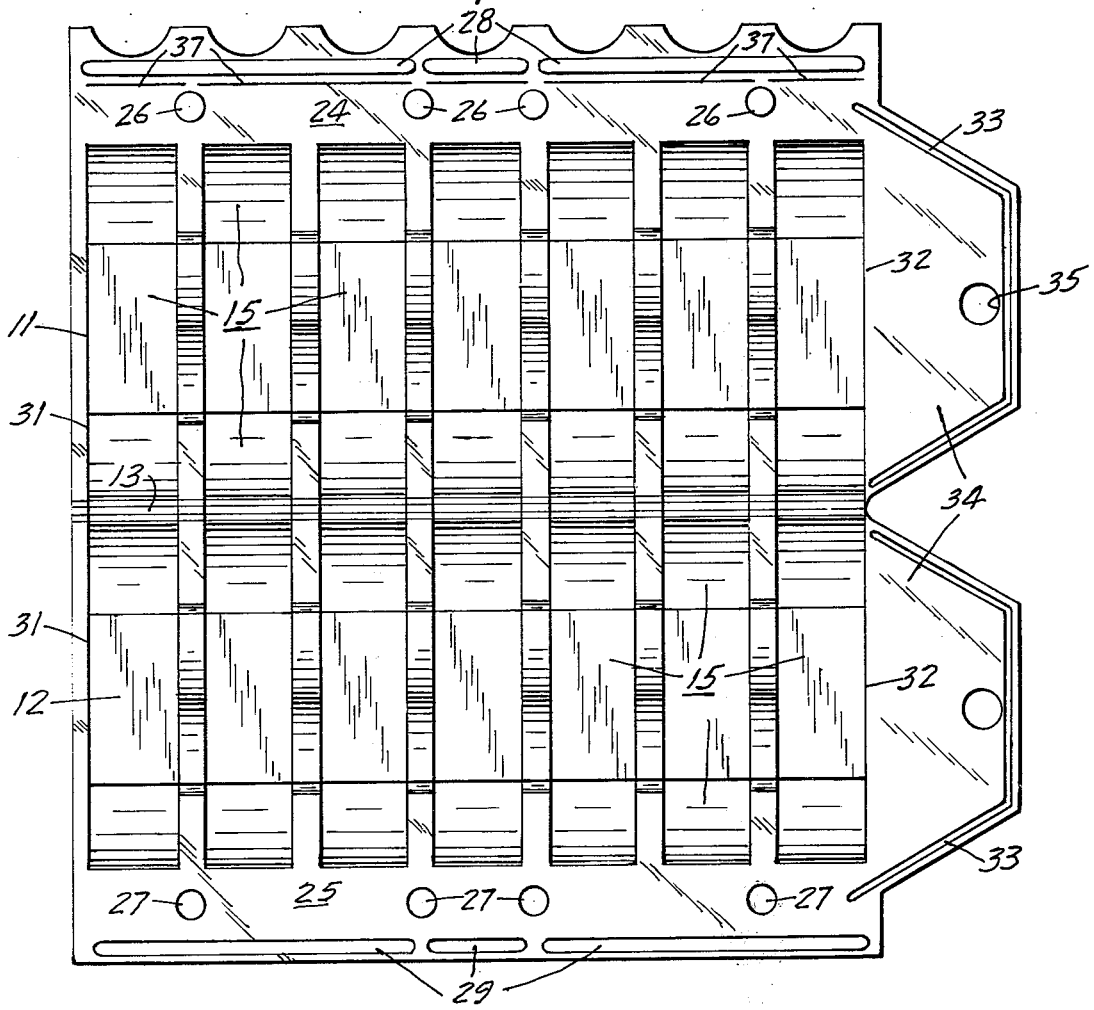
FIG. 4 is a plan view of the blank for the package.

In the illustrated embodiment the wall members 15 are disposed such that six such wall members form the hexagonally-shaped chamber 16 to receive the roll 20 as is most clearly shown in FIGS. 1 and 3. A number of the wall members 15 are disposed along the length of the package to form a plurality of chambers 16 to receive the rolls 20. This permits the package to contain a plurality of colors of decorative wrapping ribbon or a number of rolls of ribbon in a single package. Each of the chambers 16 is separated such that the edges or ends of the rolls do not contact and tend to become abraded, frayed, entwined and jumbled. The chambers are separated by partitions 21 which extend transversely of the package or radially on each side of each of the walls 15 and into the shell. Each partition 21 will engage an edge or end of a wound roll of ribbon. The partitions 21 in turn are joined by narrow bands 22 which together make the package more rigid and of a continuous integral construction.

As heretofore mentioned, each shell is provided with a flange at the edge opposite the hinge 13. The flnages form guide members for the free end of the ribbon and tend to secure the end of the ribbon to the package, holding it in place and restricting the ribbon from unwinding. A flange 24 on the shell 11 is generally planar and formed with a plurality of spaced integral interfering friction fastening circular button members 26 extending from one surface thereof toward a surface of a flange 25 on the shell 12. The shell 12 is formed with a generally planar configuration having correspondingly projecting button members 27 to receive and mate with the members 26 of the upper flange 24. The buttons 26 and 27 serve to lock the shells together and are disposed at positions out of the path of the ribbons positioned between the flanges. The buttons 27 in the flange 25 have an inside diameter which is slightly smaller than the outside diameter of the buttons 26 formed in the flange 24 affording a snap fit. At the outer edge of each of the flanges 24 and 25 is an elongate embossment 28 and 29 respectively, which embossments extend generally along the length of the flanges with two interruptions which add strength to the package. The embossment 29 has the form of a tray which receives the projection 28 projecting from the underside of the flange 24. The tray and projection are adapted to engage the ribbon at its free end to arrest the end and frictionally hold it between the flanges 24 and 25.

Figure 5:
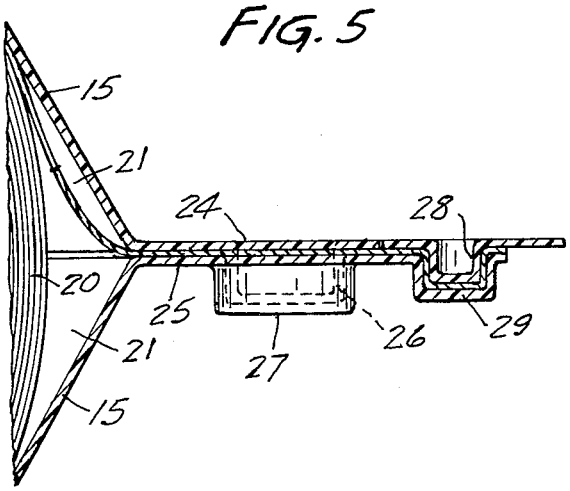
FIG. 5 is an enlarged fragmentary transverse sectional view of the guide and retaining members for the package as seen along the line 5—5 of FIG. 2.
Figure 6:
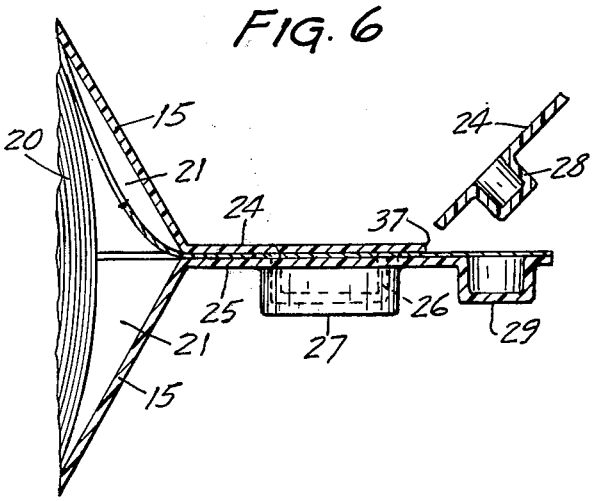
FIG. 6 is an enlarged fragmentary transverse sectional view similar to FIG. 5 with one portion of the retaining member removed therefrom.

The outer edge of the upper flange 24 is preferably scalloped such that one may easily grasp the free end of the ribbon of each of the rolls. The upper flange may also be be perforated or scored as at 37 such that the outer edge may be broken along the score line 37 removing the embossments 28 along the outer edge of the flange such that the free ends of the ribbon are no longer wrinkled by engagement of the projection 28 with the tray 29 as the user may desire. This is best illustrated in FIGS. 5 and 6 wherein initially the ribbon is arrested by the interference of the projection 28 with the tray-like embossments 29 and the user may then bend the upper portion of the flange fracturing it along the perforated or scored line 37 and discard it. The locking means afforded by the buttons 26 and 27 permit the package to be opened but serve to hold it normally closed.

Each of the shells have an end projection or wall 31 at one end and an end wall 32 at the opposite end. Extending axially of the end walls 32 on each of the shells is an integrally formed trapezoidal tab or projection 34. These projections 34 are die cut as at 35 along the axis of the package to form a hanger for receiving a spindle or rack on which to display the package. The projections 34 are also provided with ribs 33 extending around the marginal edges and outwardly for strengthening the projections.

Having thus described the preferred embodiment what is desired to be protected by Letters Patent is set forth in the appended claims:

1. A ribbon dispenser package for convolutely wound decorative ribbon products comprising a one piece molded article defining a pair of mating shells which form a plurality of axially spaced chambers when folded on a centerline, each chamber having a convolutely wound roll of ribbon disposed therein and said article having opposed planar surface portions to engage opposite surfaces of the ribbon at an end of each roll, each said shell comprising generally planar spaced outer wall members disposed in three planes, each wall member extending in a transverse direction to the package, and said planes being at an angular orientation to each other, and a flange having said planar surface portions extending along one edge of the shell lengthwise, said wall members having a width slightly greater than the axial width of a roll of said ribbon, said wall members forming part of one roll chamber being separated from the wall members forming another axially spaced roll chamber by integral radially extending partitions projecting into the shell to engage the edges of a roll of ribbon, and means formed in said flange of each shell cooperating with means in the other shell for holding said shells together adjacent the opposed edges and disposed in spaced relationship permitting the ribbon to pass therebetween from the chambers to dispense the same.

2. A package according to claim 1 wherein said partitions include separate partitions positioned to define each side of said roll chambers.

3. A package according to claim 1 wherein said wall members are angularly disposed to form roll chambers which are hexagonal in transverse section.

4. A package according to claim 1 wherein the shells are secured together along an edge opposite said flanges and said flanges comprise parallelly positioned generally planar members, one planar member being formed on each shell, and said means formed in said flange comprise retained by friction fit projections to hold the ribbon between said flanges.

5. A package according to claim 1 wherein said package if formed of one integral piece of transparent plymeric material.

6. A package according to claim 5 wherein said material is cellulose propinate.

7. A package according to claim 5 wherein said material is polyvinylchloride.

8. A package according to claim 1 wherein a projection is formed at one end of the package and is provided with hanger means for supporting the package on a rack.

* * * * *

UNITED STATES PATENT AND TRADEMARK OFFICE

CERTIFICATE OF CORRECTION

PATENT NO. : 3,948,455

DATED : April 6, 1976

INVENTOR(S) : Richard J. Schwartz

It is certified that error appears in the above-identified patent and that said Letters Patent are hereby corrected as shown below:

Col. 2, lines 45 and 46, change "of axially" to -- or axial --.

Col. 4, line 42, delete "be" (first occurrence).

Col. 6, line 14, delete "retained by".

Col. 6, line 17, change "if" to -- is --.

Col. 6, lines 17 and 18, "plymeric" should be -- polymeric --.

Signed and Sealed this twenty-second Day of June 1976

[SEAL]

Attest:

RUTH C. MASON
*Attesting Officer*

C. MARSHALL DANN
*Commissioner of Patents and Trademarks*